US008476996B2

(12) United States Patent
Liang

(10) Patent No.: US 8,476,996 B2
(45) Date of Patent: Jul. 2, 2013

(54) BISTABLE SWITCHING METHOD AND LATCHING RELAY USING THE SAME

(76) Inventor: Chih-Chuan Liang, Hsinchu (TW)

( * ) Notice: Subject to any disclaimer, the term of this patent is extended or adjusted under 35 U.S.C. 154(b) by 0 days.

(21) Appl. No.: 13/212,207

(22) Filed: Aug. 18, 2011

(65) Prior Publication Data

US 2012/0049987 A1 Mar. 1, 2012

Related U.S. Application Data

(60) Provisional application No. 61/378,394, filed on Aug. 31, 2010.

(51) Int. Cl.
*H01H 51/22* (2006.01)

(52) U.S. Cl.
USPC ..... 335/80; 335/78

(58) Field of Classification Search
USPC ..... 335/126, 131, 132
See application file for complete search history.

(56) References Cited

U.S. PATENT DOCUMENTS

| | | | | | |
|---|---|---|---|---|---|
| 3,728,651 | A | | 4/1973 | Foster | |
| 3,869,684 | A | | 3/1975 | Grobe | |
| 4,292,611 | A | * | 9/1981 | Bresson et al. | 335/6 |
| 4,307,358 | A | * | 12/1981 | Haury et al. | 335/6 |
| 4,509,026 | A | * | 4/1985 | Matsushita | 335/85 |
| 4,617,546 | A | * | 10/1986 | Kellogg et al. | 335/170 |
| 4,631,507 | A | * | 12/1986 | Guery et al. | 335/27 |
| 4,703,293 | A | | 10/1987 | Ono et al. | |
| 4,975,666 | A | | 12/1990 | Nobutoki | |
| 5,163,175 | A | * | 11/1992 | Mori et al. | 335/132 |
| 5,233,321 | A | * | 8/1993 | Blanchard et al. | 335/132 |
| 5,337,030 | A | * | 8/1994 | Mohler | 310/156.37 |
| 5,339,060 | A | * | 8/1994 | Blanchard et al. | 335/132 |
| 5,546,062 | A | * | 8/1996 | Duchemin | 335/132 |
| 5,594,399 | A | * | 1/1997 | Blanchard et al. | 335/132 |
| 5,867,081 | A | | 2/1999 | Arnoux et al. | |
| 5,912,604 | A | * | 6/1999 | Harvey et al. | 335/9 |
| 5,933,065 | A | * | 8/1999 | Duchemin | 335/190 |
| 6,034,585 | A | * | 3/2000 | Donhauser | 335/132 |
| 6,150,909 | A | * | 11/2000 | Meier | 335/132 |
| 6,674,349 | B1 | * | 1/2004 | Bolongeat et al. | 335/229 |
| 6,707,358 | B1 | | 3/2004 | Massman | |
| 6,831,535 | B1 | | 12/2004 | Wen et al. | |
| 7,199,687 | B2 | * | 4/2007 | Maruhashi et al. | 335/131 |
| 7,623,010 | B2 | * | 11/2009 | Liu | 335/6 |

* cited by examiner

*Primary Examiner* — Elvin G Enad
*Assistant Examiner* — Lisa Homza
(74) *Attorney, Agent, or Firm* — Jianq Chyun IP Office

(57) ABSTRACT

A bistable switching method and a latching relay using the same are provided. The latching relay includes a rotor shaft, a cylindrical permanent magnet, a first permeability material, a second permeability material, a coil, a hitting device and a contact unit. The method includes the following steps. While the coil is applied first direction currents, the rotor shaft rotates and to make the contact unit from the open state to the closed state or the contact unit keeps the closed state. After the first direction currents are turned off, the contact unit still remains in the closed state. Otherwise, while the coil is applied second direction currents, the rotor shaft rotates and to make the contact unit from the closed state to the open state or the contact unit keeps the open state. After the second direction currents are turned off, the contact unit still remains in the open state.

18 Claims, 10 Drawing Sheets

BISTABLE SWITCHING METHOD AND LATCHING RELAY USING THE SAME

REFERENCE TO RELATED APPLICATION

This application claims the priority benefit of U.S. Provisional Application Ser. No. 61/378,394, filed Aug. 31, 2010. The entirety of the above-mentioned patent application is hereby incorporated by reference herein and made a part of this specification.

BACKGROUND OF THE INVENTION

1. Field of the Invention

The invention generally relates to a bistable switching technology and more particularly to a bistable switching method and a latching relay using the same.

2. Description of Related Art

General mechanical switches are classified into manual switches and electrical switches. Since the manual switches are necessary to be controlled by human power, the manual switches are difficult to be used in an electrical system. Therefore, electrical switches are usually used instead. In an electrical system, a mono stable relay is usually used as an electrical switch. When using one of the states of the mono stable relay, extra power might be required to keep the state. Because of the required extra power, the mono stable relay is not adapted to an electrical system which requires a bistable device for saving power.

Besides, the current bistable switch usually swings or slides between two stable states. Therefore, the main issue of the current bistable switch is the complicated and huge construction thereof. For example, a relay described in U.S. Pat. No. 4,703,293 is huge and not useful in a tiny electrical system.

As described above, the current mono stable relay doesn't work when there is no power or power failure. Even power is applied, the mono stable relay may keep consuming power. On the other hand, the current bistable relay is complicated and huge and not useful in a tiny electrical system.

SUMMARY OF THE INVENTION

Accordingly, the invention is directed to a bistable switching method and a latching relay to the bistable switching method which can overcome the problems described above.

Other purposes and advantages of the invention can be understood from the disclosed characteristics of the invention.

The invention is directed to a bistable switching method which is suitable to a latching relay for achieving one or all of the purposes described above or other purposes. The latching relay includes a rotor shaft, a cylindrical permanent magnet, a first permeability material, a second permeability material, a coil, a hitting device, and a contact unit. The cylindrical permanent magnet covers the rotor shaft as the form of concentric circles and the cylindrical permanent magnet includes an N magnetism pole and an S magnetism pole. The first permeability material locates in one side of the cylindrical permanent magnet and the second permeability material locates in the opposite side to the first permeability material according to the center of the cylindrical permanent magnet. The coil is wrapped around the first permeability material and the second permeability material. The rotor shaft switches the contact unit from an open state or a closed state to the other state through the hitting device. The bistable latching relay is open or closed according to the state of the contact unit.

The bistable switching method includes the following steps. The rotation of the rotor shaft causes the contact unit to be transferred from the open state to the closed state or to keep the closed state when the coil is applied first direction currents. Then, the contact unit is still closed when the first direction currents are turned off. Additionally, the rotation of the rotor shaft causes the contact unit to be transferred from the closed state to the open state or to keep the open state when the coil is applied second direction currents. Then, the contact unit is still open when the second direction currents are turned off wherein the first direction currents are opposite to the second direction currents.

In an embodiment of the invention, the bistable switching method further includes the following steps. The rotor shaft has a moving track when the rotor shaft rotates. The hitting device follows the moving track when moving, and the contact unit is closed when the hitting device touches the contact unit according to the moving track. Besides, the contact unit is open when the hitting device moves away from the contact unit according to the moving track.

In an embodiment of the invention, the bistable switching method includes the following steps. The hitting device moves to the contact unit and causes the contact unit to be closed when the coil is applied the first direction currents. Besides, the hitting device moves away from the contact unit and causes the contact unit to be open when the coil is applied the second direction currents.

The present application further provides a bistable latching relay which includes a rotor shaft, a hitting device, a cylindrical permanent magnet, a first permeability material, a second permeability material, a coil, and a contact unit. The hitting device is disposed on one end of the rotor shaft. The cylindrical permanent magnet covers the rotor shaft as the form of concentric circles and the cylindrical permanent magnet includes an N magnetism pole and an S magnetism pole. The first permeability material locates in one side of the cylindrical permanent magnet and the second permeability material locates in the opposite side to the first permeability material according to the center of the cylindrical permanent magnet. The coil is wrapped around the first permeability material and the second permeability material. The contact unit is in an open state or in a closed state according to the movement of the rotor shaft through the hitting device. Two ends of the contact unit electrically connect to each other when the contact unit is in the closed state, and the two ends of the contact unit disconnect to each other when the contact unit is in the open state.

As described above, the rotation of the rotor shaft causes the contact unit to be transferred from an open state to a closed state or keeps the closed state when the coil is applied first direction currents. Furthermore, the contact unit is still closed when the first direction currents are turned off. The rotation of the rotor shaft causes the contact unit to be transferred from the closed state to the open state or keeps the open state when the coil is applied second direction currents. Furthermore, the contact unit is still open when the second direction currents are turned off. Wherein the first direction currents are opposite to the second direction currents.

In an embodiment of the invention, the bistable latching relay further includes a shell, a first shaft bearing and a second shaft bearing. The first shaft bearing and the second shaft bearing are set on the shell. Then, the first shaft bearing and the second shaft bearing are set on the two sides of the rotor shaft individually to support the rotor shaft.

In an embodiment of the invention, the rotor shaft has a moving track and the hitting device follows the moving track when moving. The contact unit is closed when the hitting device touches the contact unit according to the moving track. The contact unit is open when the hitting device moves away from the contact unit according to the moving track.

In an embodiment of the invention, the cylindrical permanent magnet includes an N pole semi-circular cylindrical permanent magnet and an S pole semi-circular cylindrical permanent magnet. The N pole semi-circular cylindrical permanent magnet is about 50 percent of the cylindrical permanent magnet, and the S pole semi-circular cylindrical permanent magnet is about 50 percent of the cylindrical permanent magnet. The first permeability material includes a first surface facing to the cylindrical magnet. The distance from the center of the first surface to the cylindrical permanent magnet is nearer than the distance from the sides of the first surface to the cylindrical permanent magnet. Similarly, the second permeability material includes a second surface facing to the cylindrical permanent magnet. The distance from the center of the second surface to the cylindrical permanent magnet is nearer than the distance from the sides of the second surface to the cylindrical permanent magnet.

In an embodiment of the invention, the contact unit includes a fixed contact, a movable contact, a fixed metal, and a movable metal. One end of the fixed metal couples to the fixed contact, and one end of the movable metal couples to the movable contact. The contact unit is closed when the movable metal electrically connects to the fixed metal through the touch between the fixed contact and the movable contact. Then, the contact unit is open when the movable metal disconnects to the fixed metal through the separation of the movable contact from the fixed contact.

In an embodiment of the invention, the movable metal includes a spring unit. The spring unit causes the contact unit to stay in the open state when the movable metal disconnects to the fixed metal.

In an embodiment of the invention, the hitting device is disposed on one side of the rotor shaft, and the hitting device rotates following the rotation of the rotor shaft. The hitting device rotates to the contact unit and causes the contact unit to be closed when the coil is applied the first direction currents. The hitting device rotates away from the contact unit and causes the contact unit to be open when the coil is applied the second direction currents.

In an embodiment of the invention, the hitting device includes a columnar fixed device and a first hitting end. The columnar fixed device covers the rotor shaft and couples to the shell. The columnar fixed device is used to offer the moving track to the rotor shaft to slide when rotating and stabilize the bistable latching relay in the open state or in the closed state. The first hitting end couples to one end of the rotor shaft. The first hitting end may be an insulator and is used to touch the contact unit.

In an embodiment of the invention, the columnar fixed device further includes a tenon and a track opening. The tenon couples to the rotor shaft orthogonally and moves as the rotor shaft rotates. The track opening is formed on the surface of the columnar fixed device to offer the moving track to the rotor shaft to slide through the tenon. In addition, trap dents are made individually in the two ends of the track opening to stabilize the tenon in each of the trap dent when the bistable latching relay is in the open state or in the closed state.

In an embodiment of the invention, the hitting device includes a rotation arm and a hitting end. The rotation arm couples to the rotor shaft and the hitting device connects to the rotation arm with the form of L. Then, the hitting end is used to touch the contact unit. The bistable latching relay further includes a block. The block is used to resist the hitting device on the block when the hitting device moves away from the contact unit. The block causes the rotation angle of the hitting device to be less than 180 degrees when the hitting device moves away from the contact unit to the block.

As described above, the bistable switching method of the invention and the bistable latching relay of the invention utilize currents to rotate the rotor shaft, which is covered by the cylindrical permanent magnet. The bistable latching relay is able to stay in one of the stable states (closed state and open state) after the currents on the coil of the bistable latching relay are turned off. Besides, the bistable latching relay of the invention includes fewer components and the conversion efficiency of the bistable latching relay, which is constructed of two permeability materials surrounding the cylindrical permanent magnet symmetrically is higher than the convention bistable latching relay. Therefore, the body of the latching relay could be small. Additionally, the bistable switching method of the invention is able to maintain the stable state after switching without any extra electrical power. Therefore, the bistable latching relay of the invention improves in the power consumption significantly. Also, the bistable lathing relay operates with a small body and stays in the stable states without any extra power.

In order to make the aforementioned features and advantages of the invention more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
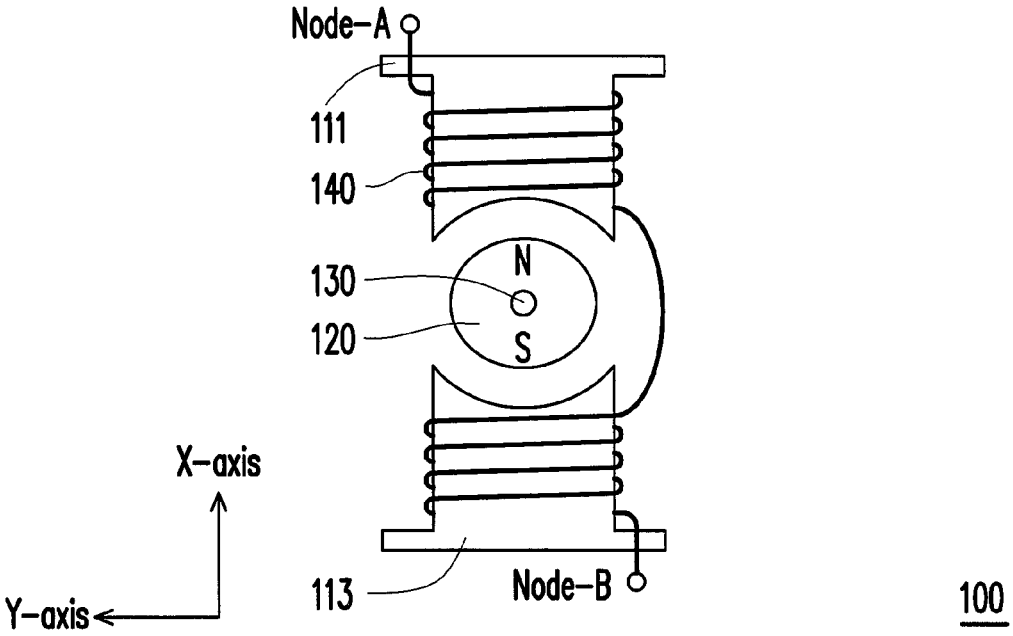
FIG. 1A, FIG. 1B, and FIG. 1C are schematic views of a bistable latching mechanism in the aspect of X-axis and Y-axis according to an embodiment.

Reference will now be made in detail to the present embodiments of the invention, examples of which are illustrated in the accompanying drawings. Wherever possible, the same reference numbers are used in the drawings and the description to refer to the same or like parts.

The coming figures will be described in different aspects which are presented as the space coordinate of X-axis, Y-axis, and Z-axis.

Figure 1B:
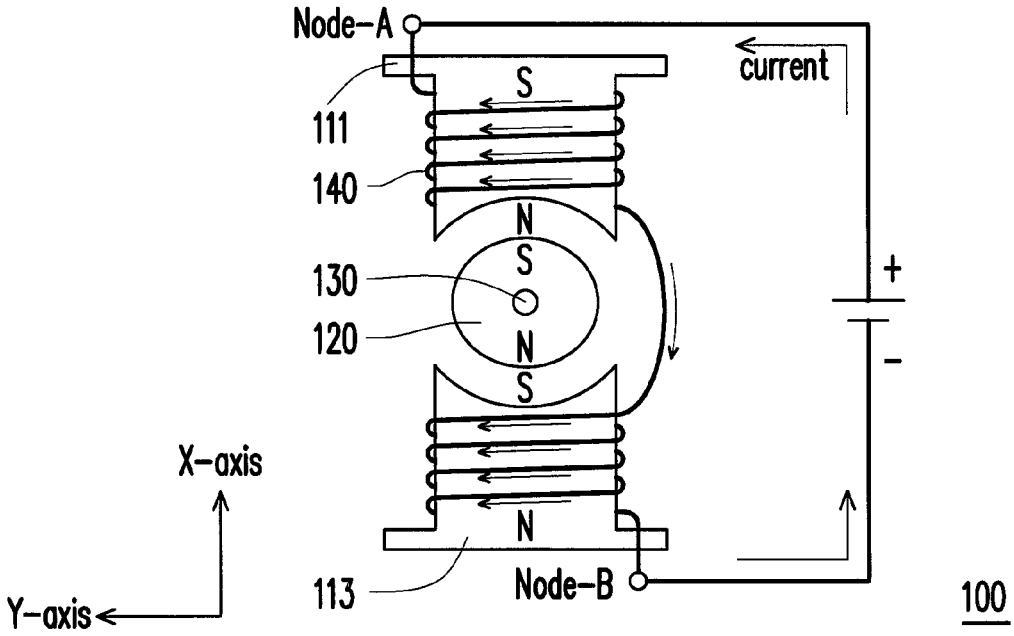
Figure 1C:
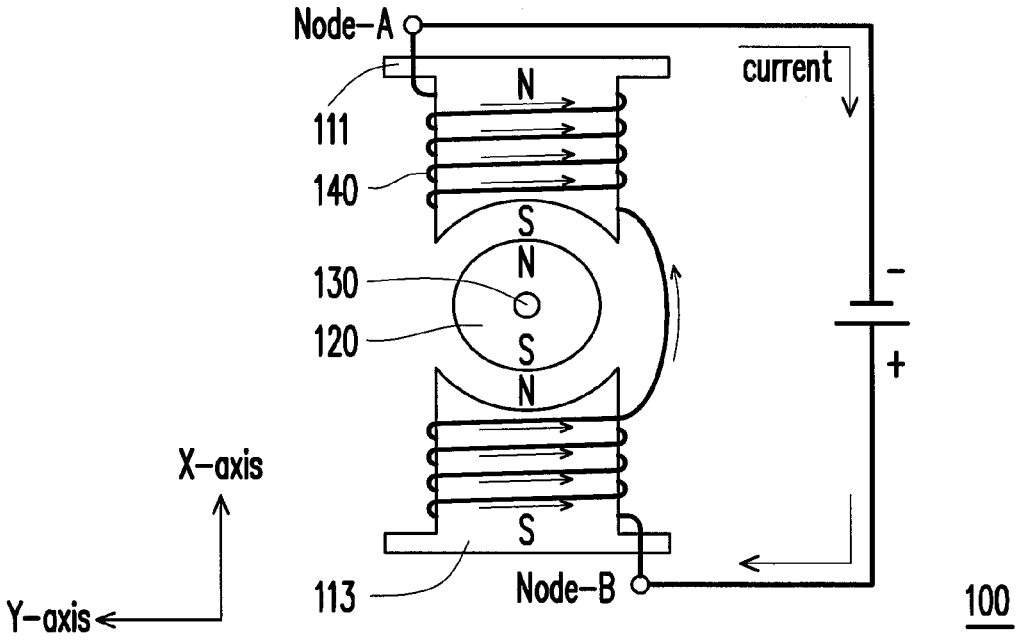

FIG. 1A, FIG. 1B and FIG. 1C are schematic views of the invention for a bistable latching mechanism 100 in the aspect of X-axis and Y-axis according to an embodiment of the invention. Please refer to FIG. 1A. The bistable latching mechanism 100 includes a first permeability material 111, a second permeability material 113, a cylindrical permanent magnet 120, a rotor shaft 130 and a coil 140.

The cylindrical permanent magnet 120 covers the rotor shaft 130 as the form of concentric circles, and the cylindrical permanent magnet 120 and the rotor shaft 130 move synchronistically. The cylindrical permanent magnet 120 includes an N magnetism pole and an S magnetism pole. Additionally, the cylindrical permanent magnet 120 includes an N pole semi-circular cylindrical permanent magnet and an S pole semi-circular cylindrical permanent magnet. The N pole semi-circular cylindrical permanent magnet is about 50 percent of the cylindrical permanent magnet and the S pole semi-circular cylindrical permanent magnet is about 50 percent of the cylindrical permanent magnet. The rotor shaft 130 is in the center of the cylindrical permanent magnet 120. Since the cylindrical permanent magnet 120 interacts with the first permeability material 111 or with the second permeability material 113, the rotor shaft 130 rotates accordingly. Then, the rotor shaft 130 and the cylindrical permanent magnet 120 rotate clockwise or counter clockwise synchronistically.

The first permeability material 111 locates in one side of the cylindrical permanent magnet 120. The second permeability material 113 locates in the opposite side to the first permeability material 111 according to the center of the cylindrical permanent magnet 120. Additionally, the first permeability material 111 and the second permeability material 113 are attracted to the cylindrical permanent magnet 120. For example, a piece of iron is attracted to the cylindrical permanent magnet 120 and it is not limited thereto. The first permeability material 111 and the second permeability material 113 are wrapped with the coil 140. When the coil 140 is applied electric currents through node Node-A and node Node-B, there are magnetic fields around the coil 140.

When there are no currents through node Node-A and node Node-B of the coil 140, the first permeability material 111 and the second permeability material 113 are attracted to the cylindrical permanent magnet 120. According to the N magnetism pole and the S magnetism pole of the cylindrical permanent magnet 120, the cylindrical permanent magnet 120 rotates to a stable phase. At this time, the magnetic attraction is the strongest between the first permeability material 111 and the S or N magnetism pole of the cylindrical permanent magnet 120. Also, the magnetic attraction is the strongest between the second permeability material 113 and the S or N magnetism pole of the cylindrical permanent magnet 120.

In other words, when the N pole semi-circular cylindrical permanent magnet of the cylindrical permanent magnet 120 faces to the first permeability material 111 thoroughly and the S-pole semi-circular cylindrical permanent magnet of the cylindrical permanent magnet 120 faces to the second permeability material 113 thoroughly, the magnetic attraction is the strongest between the first permeability material 111 and the cylindrical permanent magnet 120 and between the second permeability material 113 and the cylindrical permanent magnet 120. Similarly, when the S pole semi-circular cylindrical permanent magnet of the cylindrical permanent magnet 120 faces to the first permeability material 111 thoroughly and the N-pole semi-circular cylindrical permanent magnet of the cylindrical permanent magnet 120 faces to the second permeability material 113 thoroughly, the magnetic attraction is the strongest between the first permeability material 111 and the cylindrical permanent magnet 120. Also, the magnetic attraction is the strongest between the second permeability material 113 and the cylindrical permanent magnet 120. Theoretically, the magnetic field lines always follow the shortest distance naturally. Therefore, in the condition described above there is the biggest magnetic force between the first permeability material 111 and the cylindrical permanent magnet 120, and also between the second permeability material 113 and the cylindrical permanent magnet 120.

Please refer to FIG. 1B and FIG. 1C. When the coil 140 wrapped on the permeability materials (111 and 113) is applied currents, there are magnetic fields inside and outside the coil 140. According to the Ampere's right-handed screw rule, when a right hand holds the coil 140 and the four fingers are the same direction as electric currents, the direction of thumb is the direction of magnetic line of force which is from S magnetism pole to N magnetism pole. When a right hand holds the coil 140 and the direction of the thumb of the right hand points from the first permeability material 111 to the second permeability material 113, the direction of first direction currents is the direction of the four fingers of the right hand. On the contrary, when a right hand holds the coil 140 and the direction of the thumb of the right hand points from the second permeability material 113 to the first permeability material 111, the direction of second direction currents is the direction of the four fingers of the right hand.

When the coil 140 is applied the first direction currents (as shown in FIG. 1B), the surface of the first permeability material 111 facing to the second permeability material 113 is the N magnetism pole and the surface of the second permeable material 113 facing to the first permeability material 111 is the S magnetism pole. Meanwhile, the N pole semi-circular cylindrical permanent magnet of the cylindrical permanent magnet 120 between the first permeability material 111 and the second permeability material 113 rotates according to the repulsion of the N magnetic surface of the first permeability material 111 and the attraction of the S magnetic surface of the second permeability material 113.

Similarly, the S pole semi-circular cylindrical permanent magnet of the cylindrical permanent magnet 120 between the first permeability material 111 and the second permeability material 113 rotates according to the attraction of the N magnetic surface of the first permeability material 111 and the repulsion of the S magnetic surface of the second permeability material 113. Finally, the cylindrical permanent magnet 120 rotates to a stable phase when the S pole semi-circular cylindrical permanent magnet of the cylindrical permanent magnet 120 faces to the N magnetic surface of the first permeability material 111 and the N pole semi-circular cylindrical permanent magnet of the cylindrical permanent magnet 120 faces to the S magnetic surface of the second permeability material 113.

Besides, when the coil 140 is applied the second direction currents (as shown in FIG. 1C), the cylindrical permanent magnet 120 rotates to a stable phase. Meanwhile, the S pole semi-circular cylindrical permanent magnet of the cylindrical permanent magnet 120 faces to the N magnetic surface of the second permeability material 113 and the N pole semi-circular cylindrical permanent magnet of the cylindrical permanent magnet 120 faces to the S magnetic surface of the first permeability material 111.

Figure 2:
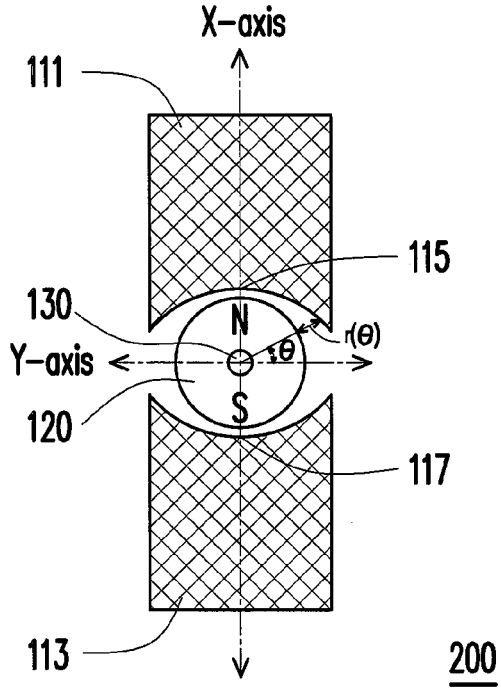
FIG. 2 is a profile of a bistable latching mechanism in the aspect of X-axis and Y-axis according to an embodiment of the invention.

FIG. 2 shows the profile of the bistable latching mechanism 200 in the aspect of X-axis and Y-axis according to an embodiment of the invention. Please refer to FIG. 2. The surface of the first permeability material 111 facing to the cylindrical permanent magnet 120 includes a first surface 115. The distance from the center of the first surface 115 to the cylindrical permanent magnet 120 is nearer than the distance from the sides of the first surface 115 to the cylindrical permanent magnet 120. Additionally, the surface of the second permeability material 113 facing to the cylindrical permanent magnet 120 includes a second surface 117. The distance from the center of the second surface 117 to the cylindrical permanent magnet 120 is nearer than the distance from the sides of the second surface 117 to the cylindrical permanent magnet 120. For example, $r(\theta)$ is defined as a gap distance between the surface (115 or 117) and the cylindrical permanent magnet 120 wherein $\theta$ is represented a rotation angle as shown in FIG. 2. The center of the surface is located in 90° or 270°. Then, the relation between r and $\theta$ is $r(90°)<r(45°)<r(0°)$, or $r(90°)<r(135°)<r(180°)$, $r(270°)<r(225°)<r(180°)$, and $r(270°)<r(315°)<r(360°)$. To make a generalization, we can conclude the relation between r and $\theta$ below:

$r(\theta1)<r(\theta2)$ where $0°\leqq\theta1<90°$, $0°\leqq\theta2<90°$, and $\theta1>\theta2$;

$r(\theta3)>r(\theta4)$ where $90°\leqq\theta3<180°$, $90°\leqq\theta4<180°$, and $\theta3>\theta4$;

$r(\theta5)<r(\theta6)$ where $180°\leqq\theta5<270°$, $180°\leqq\theta6<270°$, and $\theta5>\theta6$;

$r(\theta7)>r(\theta8)$ where $270°\leqq\theta7<360°$, $270°\leqq\theta8<360°$, and $\theta7>\theta8$.

Accordingly, the surface is formed following the rules described above, and the surface may be a flat surface, an arc surface, or a sphere surface, and it is not limited thereto.

The magnetic force is inversely proportional to the square of the distance between magnetic materials or between a magnetic material and a permeability material. Because the distance from the center of the first surface 115 to the cylindrical permanent magnet 120 or from the center of the second surface 117 to the cylindrical permanent magnet 120 is nearer than the distance from the sides of the first surface 115 to the cylindrical permanent magnet 120 or from the sides of the second surface 117 to the cylindrical permanent magnet 120, the magnetic force is enhanced while the N pole semi-circular cylindrical permanent magnet of the cylindrical permanent magnet 120 thoroughly faces to the first permeability material 111 or faces to the second material 113. Similarly, the magnetic force is enhanced when the S pole semi-circular cylindrical permanent magnet of the permanent cylindrical magnet 120 thoroughly faces to the first permeability material 111 or faces to the second material 113.

It is noteworthy that the bistable latching mechanism 100 or 200 is able to rotate with only the first permeability material 111 and the coil 140. However, for the best operation, the bistable latching relay includes the second permeability material 113.

Figure 3A:
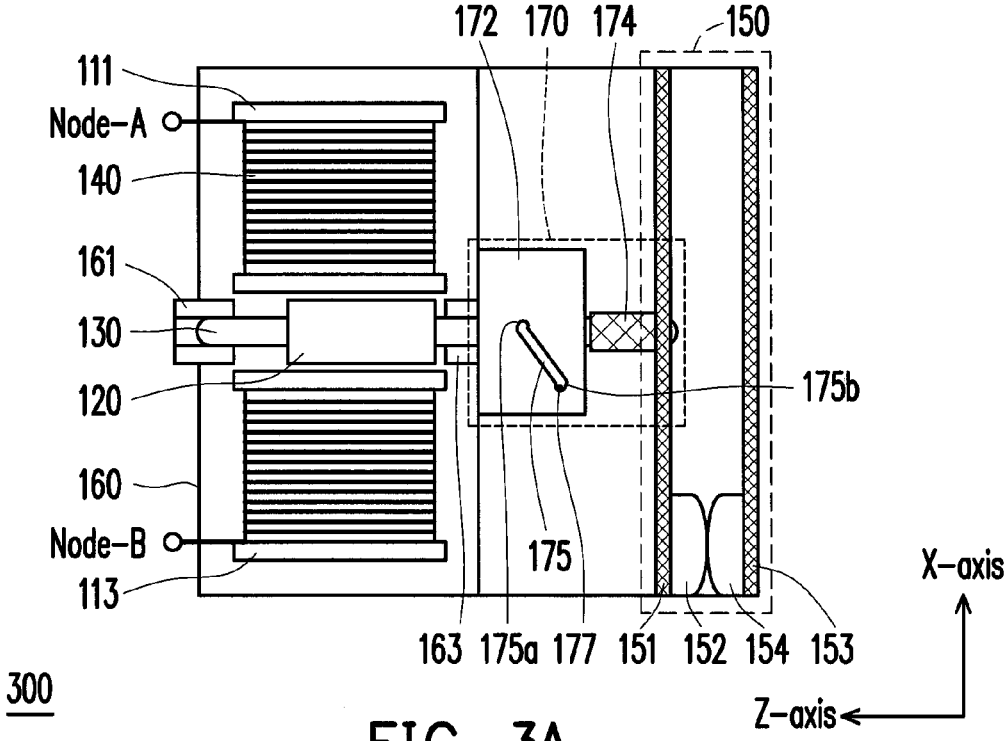
FIG. 3A and FIG. 3B are schematic views of a bistable latching relay in the aspect of X-axis and Z-axis according to an embodiment of the invention.
Figure 3B:
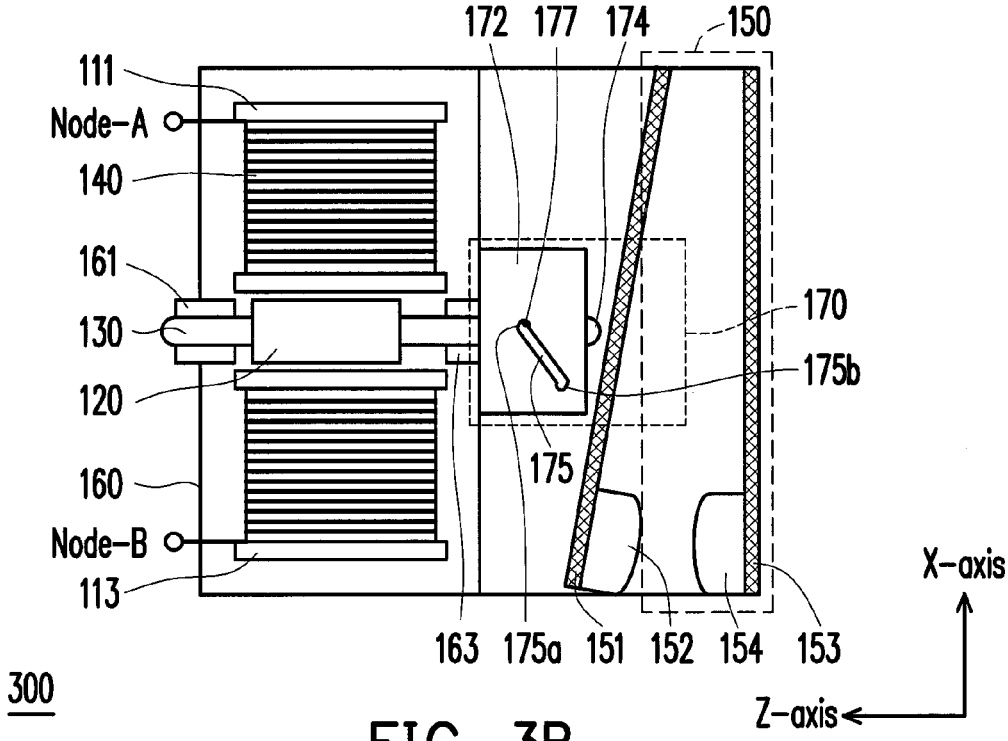

According to the description of the embodiment disclosed above, FIG. 3A and FIG. 3B show schematic views of a bistable latching relay 300 in the aspect of X-axis and Z-axis according to an embodiment of the invention. Please refer to FIG. 3A and FIG. 3B. The bistable latching relay 300 further includes a contact unit 150, a shell 160, a first shaft bearing 161 and a second shaft bearing 163. The contact unit 150 includes a first end and a second end, and is in an open state or in a closed state according to the movement of the rotor shaft 130 to switch the states between two ends of the contact unit 150. The two ends of the contact unit 150 electrically connect to each other when the contact unit 150 is closed, and the two ends of the contact unit 150 disconnect to each other when the contact unit is open. The contact unit 150 may include a movable contact 152, a fixed contact 154, a movable metal 151 and a fixed metal 153. One end of the fixed metal 153 couples to the fixed contact 154, and one end of the movable metal 151 couples to the movable contact 152.

When the movable metal 151 electrically connects to the fixed metal 153 through the touch between the fixed contact 154 and the movable contact 152, the contact unit 150 is in the closed state and the bistable latching relay 300 is closed. Comparatively, when the movable metal 151 disconnects to the fixed metal 153 through the separation of the movable contact 152 from the fixed contact 154, the contact unit 150 is in the open state and the bistable latching relay 300 is open.

According to the direction of the first direction currents and the direction of the second direction currents, the cylindrical permanent magnet 120 rotates to different stable phases. Then, the contact unit 150 is open or closed accordingly. Because the contact unit 150 includes the movable metal 151 which is elastic, the movable metal 151 jumps out of the fixed metal 153 and causes the contact unit 150 to be in the open state when the rotor shaft 130 moves away from the contact unit 150.

The shell 160 is drilled the first shaft bearing 161 and the second shaft bearing 163. In addition, the rotor shaft 130 has a moving track when rotating, and the moving track is spiral according to the rotation and the sliding of the rotor shaft 130. Then, the contact unit 150 locates in the moving track. When the rotor shaft 130 moves to the contact unit 150 according to the moving track, the contact unit 150 is closed. When the rotor shaft 130 moves away from the contact unit 150 according to the moving track, the contact unit 150 is open.

When the coil 140 is applied the first direction currents (as shown in FIG. 3A), the rotation and sliding of the rotor shaft 130 cause the rotor shaft 130 to move to the contact unit 150 and causes the contact unit 150 to be transferred from the open state to the closed state or keeps the closed state. The contact unit 150 is still closed when the first direction currents are turned off. When the coil 140 is applied the second direction currents (as shown in FIG. 3B), the rotation and the sliding of the rotor shaft 130 cause the rotor shaft 130 to move away from the contact unit 150. Since the movable metal 151 is elastic, the movable metal 151 is forced to disconnect to the fixed metal 153 and causes the contact unit 150 to be transferred from the closed state to the open state or keeps the open state. The contact unit 150 is still open when the second direction currents are turned off.

When the rotor shaft 130 moves to the contact unit 150, the rotor shaft 130 is closed through a hitting device 170. The hitting device 170 couples to one side of the rotor shaft 130 and the shell 160, and the hitting device 170 rotates following the rotation of the rotor shaft 130. The hitting device 170 rotates to the contact unit 150 and causes the contact unit 150 to be closed when the coil 140 is applied the first direction currents. The hitting device 170 rotates away from the contact unit 150 and causes the contact unit 150 to be open when the coil 140 is applied the second direction currents.

In detail, the hitting device 170 includes a columnar fixed device 172 and a first hitting end 174. The columnar fixed device 172 covers the rotor shaft 130 and couples to the shell 160, and the columnar fixed device 172 is used to offer the moving track to the rotor shaft 130 to slide when rotating and stabilize the bistable latching relay 300 in the open state or in the closed state. The first hitting end 174 couples to one end of the rotor shaft 130 and the first hitting end 174 is used to touch the contact unit 150. For avoiding the leakage of electric currents according to the embodiment of the bistable latching relay 300, the first hitting end 174 should not be a conductor but an insulator instead.

The columnar fixed device 172 further includes a tenon 177 and a track opening 175. The tenon 177 couples to the rotor shaft 130 orthogonally and the tenon 177 moves as the rotor shaft 130 rotates. The track opening 175 is formed on the surface of the columnar fixed device 172 to offer the moving track to the rotor shaft 130 to slide through the tenon 177. Then, trap dents (175*a* and 175*b*) are made individually in the two ends of the track opening 175 to stabilize the tenon 177 when the bistable latching relay is stable in the open or closed state.

Figure 3C:
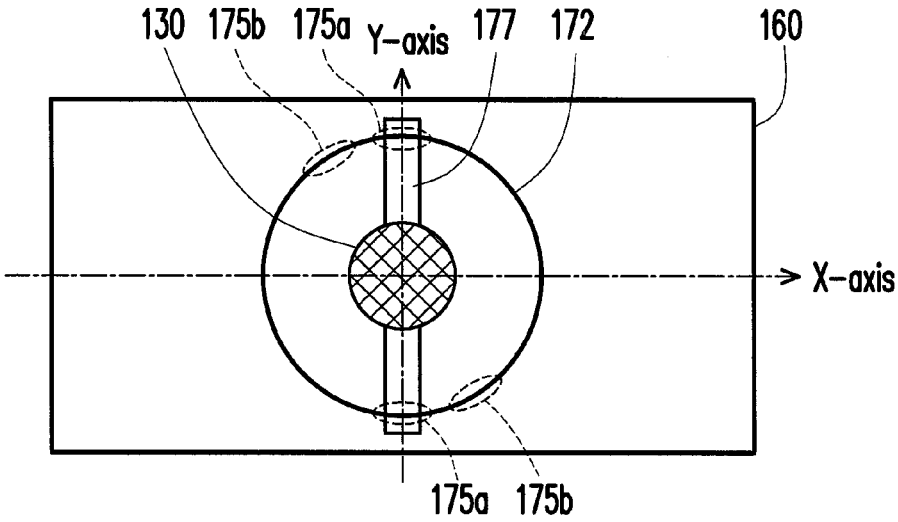
FIG. 3C shows a schematic view of a columnar fixed device in the aspect of X-axis and Y-axis according to an embodiment of the invention.

FIG. 3C shows a schematic view of a columnar fixed device 172 in the aspect of X-axis and Y-axis according to an embodiment of the invention. Those circles displayed as imaginary lines in FIG. 3C represent the schematic view of the trap dent 175*a* and of the trap dent 175*b* which can not be really seen in the aspect of X-axis and Y-axis. Please refer to FIG. 3A to FIG. 3C. In the aspect of X-axis and Y-axis described in FIG. 3C, the tenon 177 rotates between trap dent 175*a* and trap dent 175*b* according to the moving track. At the same time, in the aspect of X-axis and Z-axis, described in FIG. 3A and FIG. 3B, the tenon 177 slides between trap dent 175*a* and trap dent 175*b* along the direction of Z-axis and of X-axis following the moving track.

Figure 3D:
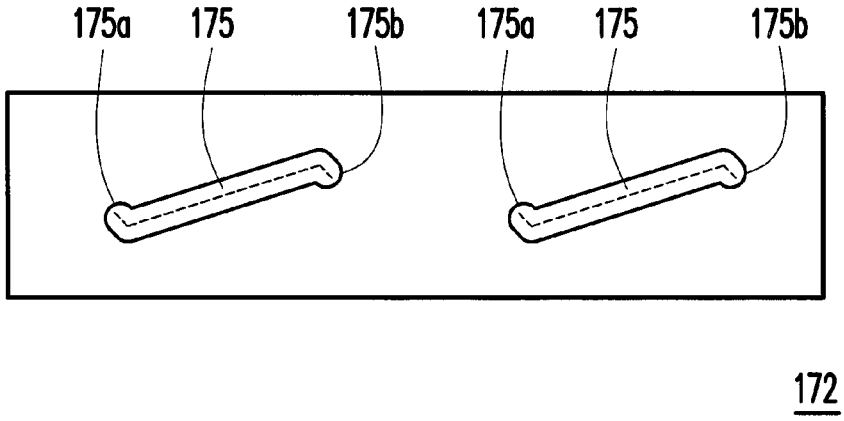
FIG. 3D shows an unfolding schematic view of a columnar fixed device according to an embodiment of the invention.

FIG. 3D shows an unfolding schematic view of a columnar fixed device 172 according to an embodiment of the invention. Please refer to FIG. 3A to FIG. 3D. In this embodiment, the columnar fixed device 172 includes two track openings 175. In the two ends of the track opening 175 are designed to make two trap dents (175*a* and 175*b*) individually. Due to the design of the trap dent 175*a* and trap dent 175*b*, the columnar fixed device 172 is more stable when the magnetic force of the bistable latching relay 300 becomes weak or lost.

Figure 4A:
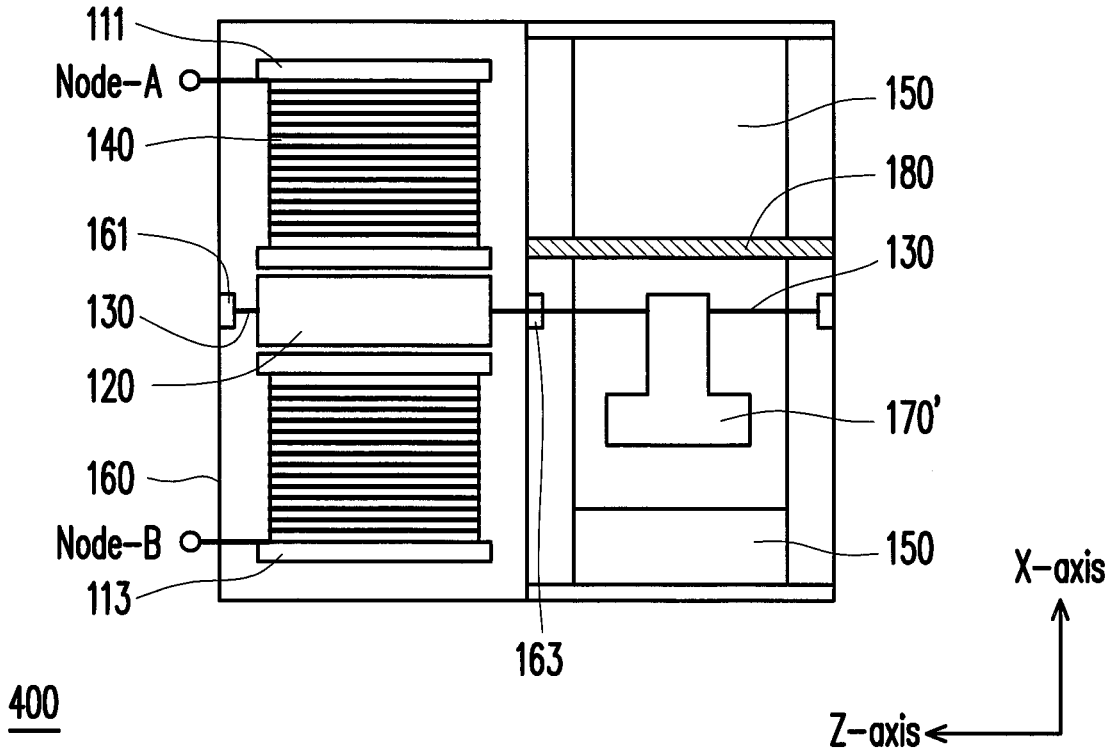
FIG. 4A shows a schematic view of a bistable latching relay in the aspect of X-axis and Z-axis according to an embodiment of the invention.
Figure 4B:
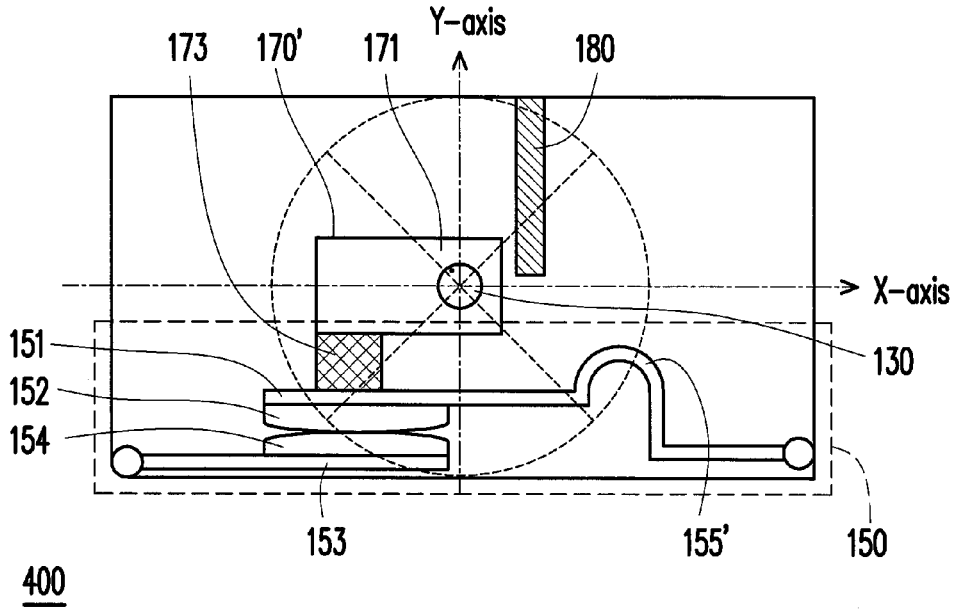
FIG. 4B, and FIG. 4C show schematic views of the hitting device and contact unit of a bistable latching relay in the aspect of X-axis and Y-axis according to an embodiment of the invention.
Figure 4C:
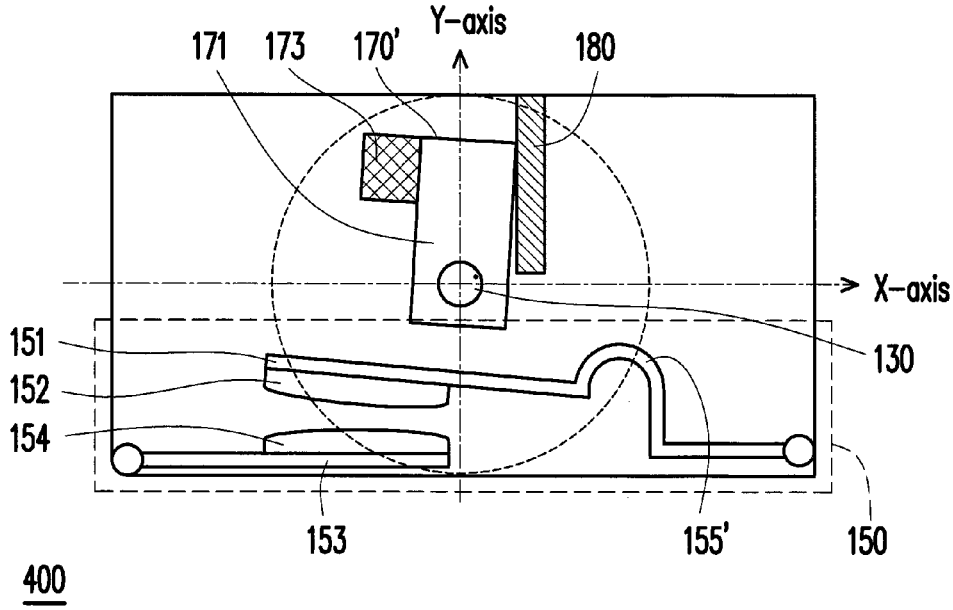

FIG. 4A shows a schematic view of a bistable latching relay 400 in the aspect of X-axis and Z-axis according to an embodiment of the invention. FIG. 4B and FIG. 4C show schematic views of the hitting device 170' and contact unit 150 of a bistable latching relay 400 in the aspect of X-axis and Y-axis according to an embodiment of the invention. Please refer to FIG. 4A, FIG. 4B and FIG. 4C. According to the description of the embodiment disclosed by FIG. 4A, FIG. 4B and FIG. 4C, the bistable latching relay 400 includes a contact unit 150, a shell 160, a first shaft bearing 161, a second shaft bearing 163, a hitting device 170' and a block 180. The contact unit 150 includes a movable contact 152, a fixed contact 154, a movable metal 151 and a fixed metal 153. The hitting device 170' includes a rotation arm 171 and a second hitting end 173. The rotation arm 171 connects to the second hitting end 173 for touching the contact unit 150. For avoiding the leakage of electric currents according to the embodiment of the bistable latching relay 400, the second hitting end 173 should not be a conductor but an insulator instead.

The first shaft bearing 161 and the second shaft bearing 163 are on the shell 160 and locate in the two ends of the rotor shaft 130 individually for supporting the rotor shaft 130. One end of the rotor shaft 130 couples to the rotation arm 171 of the hitting device 170' as the axis of the hitting device 170'. When the coil 140 is applied first direction currents (as shown in FIG. 4B), the hitting device 170' rotates to the contact unit 150 and causes the contact unit 150 to be closed. When the coil 140 is applied second direction currents (as shown in FIG. 4C), the hitting device 170' rotates away from the contact unit 150 and causes the contact unit 150 to be open.

It should be noted that there is a mark as a black point in the rotor shaft 130 as shown in FIG. 4B and FIG. 4C. In FIG. 4B, the mark is in the second quadrant of the aspect of X-axis and Y-axis. In FIG. 4C, the mark is in the first quadrant of the aspect of X-axis and Y-axis. As described above, the different position of the mark represents that the hitting device 170' moves as the rotation of the rotor shaft 130.

Figure 4D:
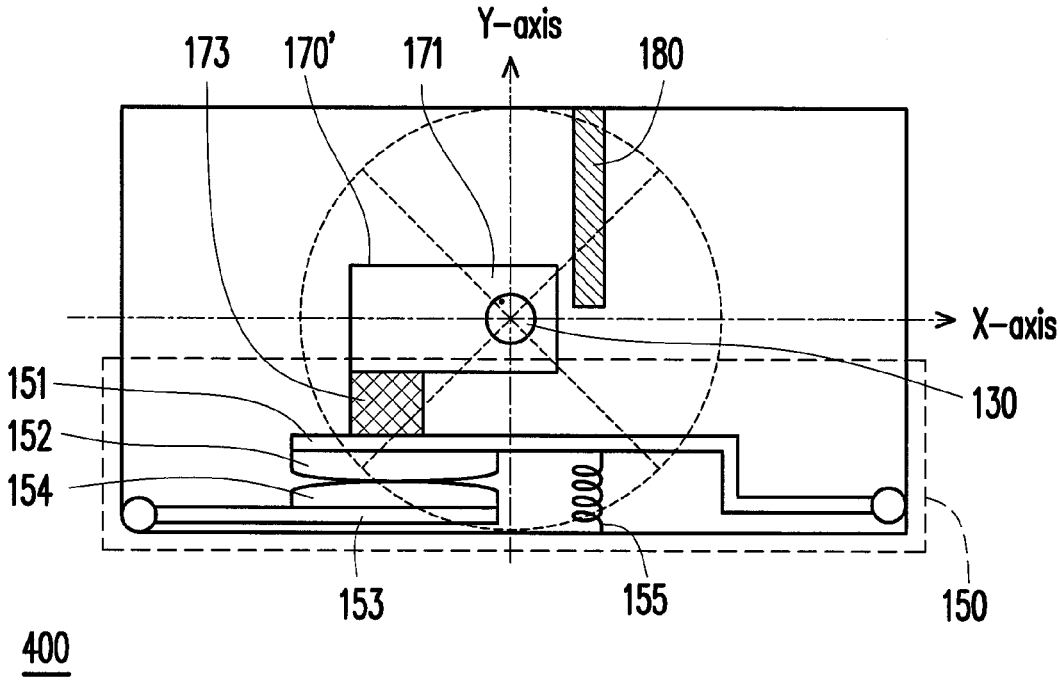
FIG. 4D and FIG. 4E are schematic views of the hitting device and contact unit of a bistable latching relay in the aspect of X-axis and Y-axis according to another embodiment of the invention.
Figure 4E:
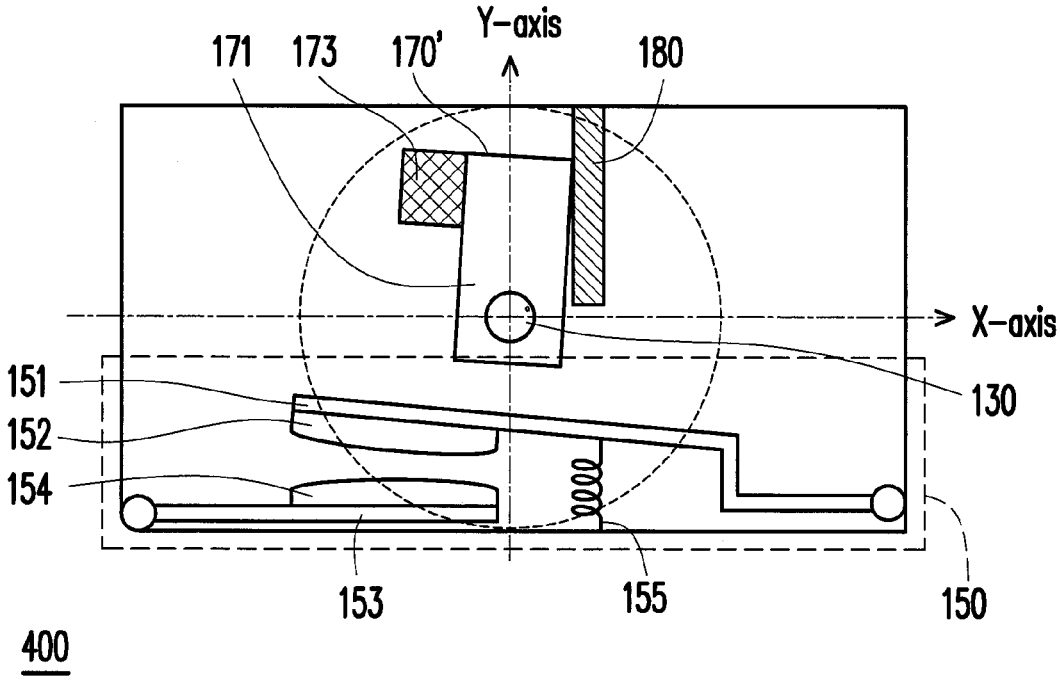

FIG. 4D and FIG. 4E show schematic views of the hitting device 170' and contact unit 150 of a bistable latching relay 400 in the aspect of X-axis and Y-axis according to another embodiment of the invention. Please refer to FIG. 4D and FIG. 4E. Because the contact unit 150 includes the movable metal 151, the movable metal 151 moves away from the fixed metal 153 and causes the contact unit 150 to be in the open state when the rotor shaft 130 rotates away from the contact unit 150.

Furthermore, please refer to FIG. 4B to FIG. 4E, the movable metal 151 may include a spring unit 155 or a spring unit 155'. The spring unit 155 or the spring unit 155' causes the movable metal 151 to jump out of the fixed metal 153 and causes the contact unit 150 to be in the open state when the hitting device 170' rotates away from the contact unit 150.

Additionally, the spring unit 155' could be an elastic arm as shown in FIG. 4B and FIG. 4C, and the spring unit 155 could be a spring as shown in FIG. 4D and FIG. 4E.

It is noteworthy that the strength of the hitting device 170' is greater than the strength of the movable metal 151. Additionally, the block 180 resists the hitting device 170' when the hitting device 170' rotates away from the contact unit 150. Besides, in a better embodiment, the rotation angle that the hitting device 170' rotates away from the contact unit 150 to the block 180 is less than 180 degrees. This design stabilizes the hitting device 170' on the block 180 when the hitting device 170' rotates away from the contact unit 150.

Figure 5:
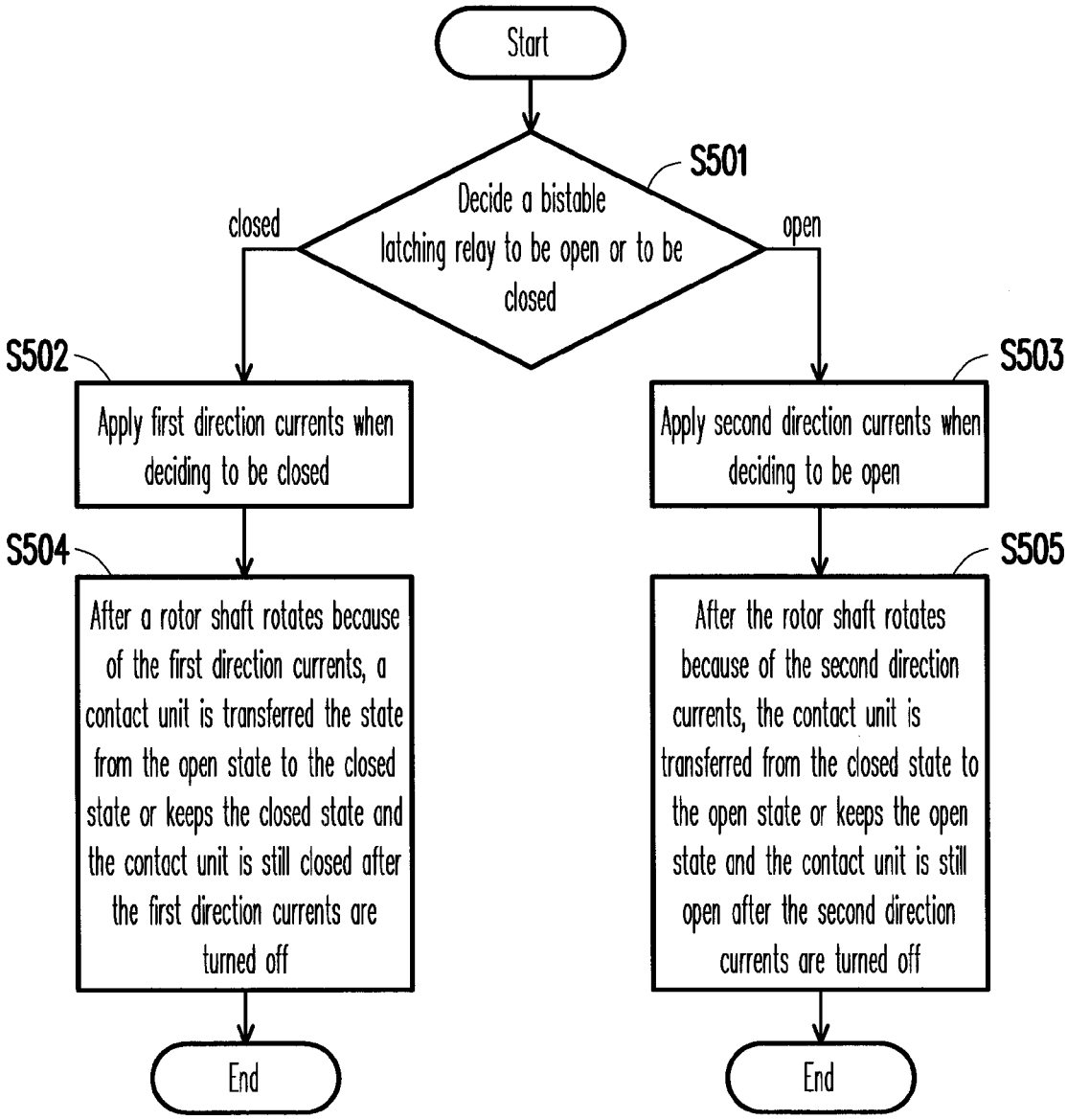
FIG. 5 is a flowchart illustrating a bistable switching method according to an embodiment of the invention.

Based on the description of the embodiments disclosed above, a bistable switching method is concluded. More clearly, FIG. 5 shows a flowchart of the bistable switching method according to an embodiment of the invention. Please refer to the FIG. 5, the bistable switching method according to the embodiment includes the following steps.

Decide a bistable latching relay to be open or to be closed (step S501).

Apply first direction currents when deciding to be closed (step S502). After a rotor shaft rotates because of the first direction currents, a contact unit is transferred the state from the open state to the closed state or keeps the closed state and the contact unit is still closed after the first direction currents are turned off (step S504).

Apply second direction currents when deciding to be open (step S503). After the rotor shaft rotates because of the second direction currents, the contact unit is transferred from the closed state to the open state or keeps the open state and the contact unit is still open after the second direction currents are turned off (step S505).

Figure 6:
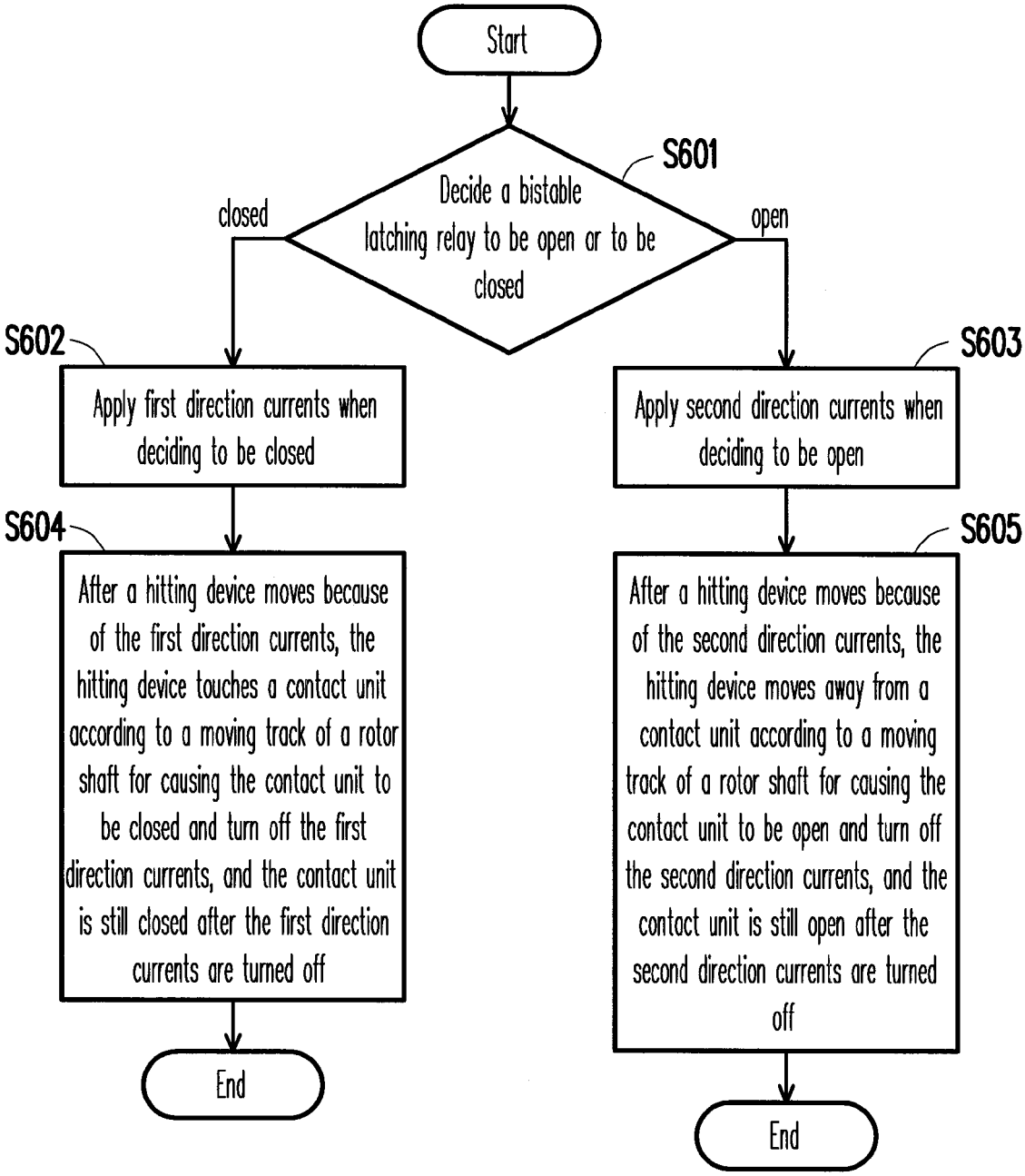
FIG. 6 is a flowchart illustrating a bistable switching method according to another embodiment of the invention.

FIG. 6 shows a bistable switching method according to another embodiment of the invention. Please refer to FIG. 6. Comparing to FIG. 5, the rotor shaft of the embodiment (as shown in FIG. 3A to FIG. 3D) includes a moving track when rotating and a contact unit locates in the moving track. The bistable switching method of FIG. 6 includes the following steps.

Decide a bistable latching relay to be open or to be closed (step S601).

Apply first direction currents when deciding to be closed (step S602). After a hitting device moves because of the first direction currents, the hitting device touches a contact unit according to a moving track of a rotor shaft for causing the contact unit to be closed and turn off the first direction currents, and the contact unit is still closed after the first direction currents are turned off (step S604).

Apply second direction currents when deciding to be open (step S603). After a hitting device moves because of the second direction currents, the hitting device moves away from a contact unit according to a moving track of a rotor shaft for causing the contact unit to be open and turn off the second direction currents, and the contact unit is still open after the second direction currents are turned off (step S605).

Figure 7:
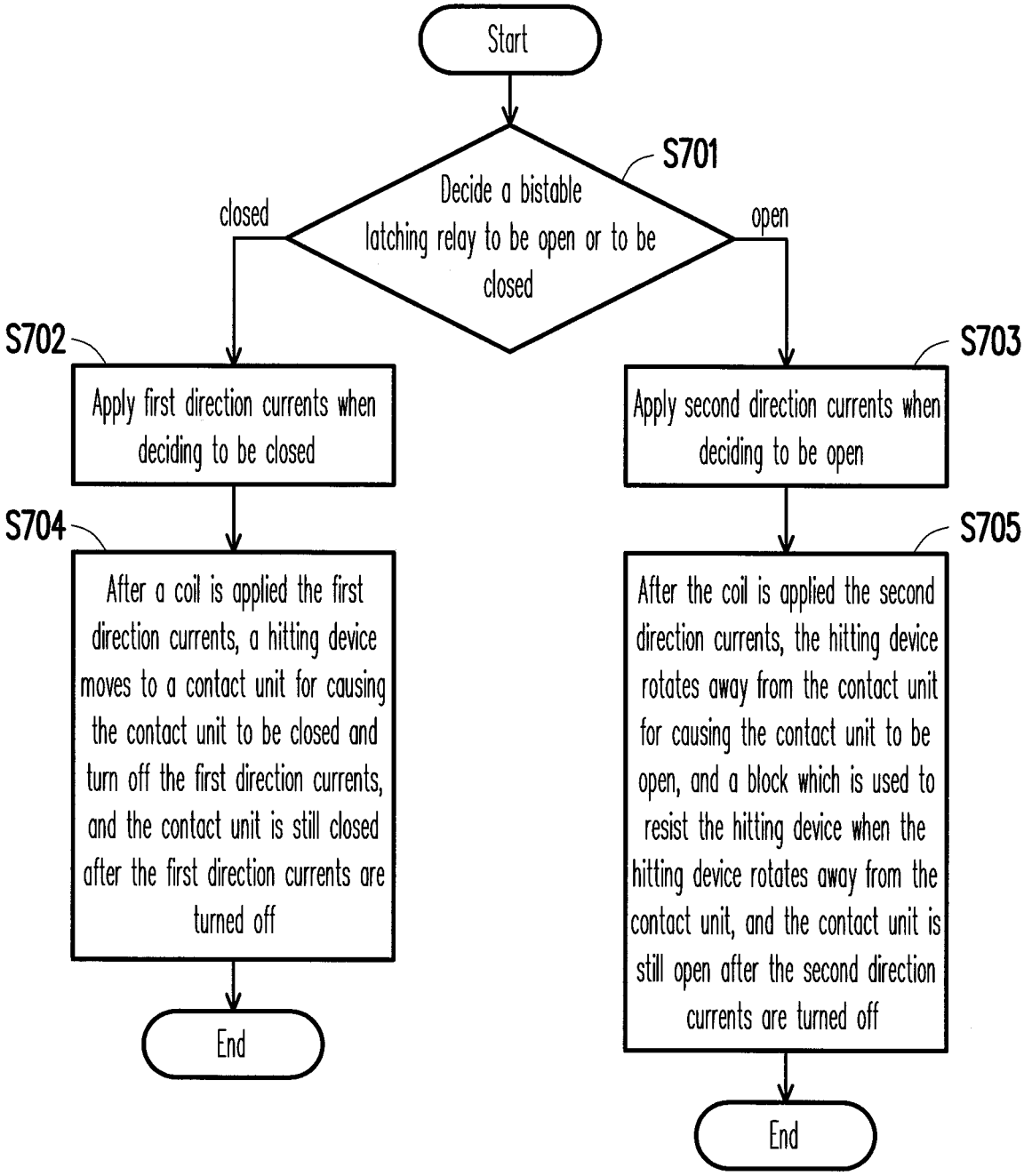
FIG. 7 is a flowchart illustrating a bistable switching method according to another embodiment of the invention.

FIG. 7 shows a bistable switching method according to another embodiment of the invention. Please refer to FIG. 7. Comparing to FIG. 5, the bistable latching relay (as shown in FIG. 4A to FIG. 4E) may include a hitting device which is fixed in one end of the rotor shaft and a block which is used to resist the hitting device when the hitting device rotates away from the contact unit. The bistable switching method of FIG. 7 includes the following steps.

Decide a bistable latching relay to be open or to be closed (step S701).

Apply first direction currents when deciding to be closed (step S702). After a coil is applied the first direction currents, a hitting device moves to a contact unit for causing the contact unit to be closed and turn off the first direction currents, and the contact unit is still closed after the first direction currents are turned off (step S704).

Apply second direction currents when deciding to be open (step S703). After the coil is applied the second direction currents, the hitting device rotates away from the contact unit for causing the contact unit to be open, and a block which is used to resist the hitting device when the hitting device rotates away from the contact unit, and the contact unit is still open after the second direction currents are turned off (step S705).

It is noteworthy that the bistable switching method according to the embodiments of the invention. Currents are only applied when the rotor shaft of the bistable latching relay rotates. When the bistable latching relay is in the open state or closed state, no currents are required to the coil of the bistable latching relay and the bistable latching relay is stable in the open or closed state.

The details of the bistable switching method according to the invention have been described clearly in the exemplary embodiments above. Please note that the details of the embodiments for the bistable switching method will not be repeated again.

In summary, according to the bistable switching method and the bistable latching relay of the invention, the bistable latching relay rotates the rotor shaft which is covered by the cylindrical permanent magnet by applying currents to the coil. Besides, the bistable latching relay stays in a stable state (closed state or open state). In addition, the bistable latching relay of the invention includes fewer components and is higher conversion efficiency, so the required space is not large for using the bistable latching relay. Furthermore, according to the bistable switching method of the invention, no extra power is required in the stable state of the contact unit. Therefore, the bistable latching relay of the invention improves in the small space requirements and in the power saving while operating.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A bistable switching method, suitable for a latching relay, the latching relay comprising a rotor shaft, a cylindrical permanent magnet, a first permeability material, a second permeability material, a coil, a hitting device and a contact unit, the cylindrical permanent magnet covering on the rotor shaft as the form of concentric circles, the first permeability material locating in one side of the cylindrical permanent magnet, the second permeability material locating in the opposite side to the first permeability material according to the center of the cylindrical permanent magnet, the coil wrapped around the first permeability material and the second permeability material, the rotor shaft switching the contact unit from an open state or a closed state to other state through the hitting device, the latching relay being open or closed according to the state of the contact unit, the bistable switching method comprising:

applying first direction currents to the coil to generate a first force by magnetic fields formed inside and outside of the coil;

the first force driving the rotor shaft rotating to drive the contact unit being transferred from an open state to a closed state or keeping the contact unit being in the closed state;

turning the first direction currents off, the contact unit still being closed in a stable phase by a second force, wherein the second force is from magnetic attraction between the cylindrical permanent magnet and the first and second permeability materials;

applying second direction currents to the coil to generate a third force by magnetic fields formed inside and outside the coiling;

the third force driving the rotor shaft rotating to drive the contact unit being transferred from the closed state to the open state or keeping the contact unit being in the open state; and turning the second direction currents off, wherein the contact unit still being open in a stable phase by a fourth force, wherein the fourth force is from magnetic attraction between the cylindrical permanent magnet and the first and second permeability materials.

2. The bistable switching method according to claim 1 further comprising:

the rotor shaft having a moving track when the rotor shaft rotates, the hitting device following the moving track when moving, the contact unit being closed when the hitting device touches the contact unit according to the moving track, the contact unit being open when the hitting device moves away from the contact unit according to the moving track.

3. A bistable latching relay comprising:

a rotor shaft;

a shell, supporting the rotor shaft;

a hitting device, disposed on one end of the rotor shaft;

a cylindrical permanent magnet, covering on the rotor shaft as the form of concentric circle, wherein the cylindrical permanent magnet at least comprises an N magnetism pole and an S magnetism pole;

a first permeability material, locating in a side of the cylindrical permanent magnet, wherein the first permeability material has a first surface facing to the cylindrical permanent magnet, and the first surface is used to change the magnetic attraction force of different place of the first surface for directing the cylindrical permanent magnet to a first stable position, wherein the magnetic attraction exists between the cylindrical permanent magnet and the first permeability material;

a second permeability material, locating in the opposite side to the first permeability material according to a center of the cylindrical permanent magnet, wherein the second permeability material has a second surface facing to the cylindrical permanent magnet, and the second surface is used to change the magnetic attraction force of different place of the second surface for directing the cylindrical permanent magnet to a second stable position, wherein the magnetic attraction exists between the cylindrical permanent magnet and the second permeability material;

a coil, wrapped around the first permeability material and the second permeability material; and a contact unit, being in an open state or in a closed state according to a movement of the rotor shaft through the hitting device, two ends of the contact unit electrically connecting to each other when the contact unit is in the closed state, the two ends of the contact unit disconnecting to each other when the contact unit is in the open state.

4. The bistable latching relay according to claim 3, wherein the contact unit further comprising:

a fixed contact;

a movable contact;

a fixed metal, one end of the fixed metal coupling to the fixed contact; and a movable metal, one end of the movable metal coupling to the movable contact wherein the contact unit is closed when the movable metal electrically connects to the fixed metal through a touch between the fixed contact and the movable contact, and the contact unit is open when the movable metal disconnects to the fixed metal through a separation of the movable contact from the fixed contact.

5. The bistable latching relay according to claim 4, wherein the movable metal comprises an elastic material and the movable metal causes the contact unit to stay in the open state when the movable metal disconnects to the fixed metal.

6. The bistable latching relay according to claim 3, wherein the hitting device comprises:

a rotation arm, coupling to the rotor shaft; and a second hitting end, connecting to the rotation arm with the form of L, the hitting end used to touch the contact unit.

7. The bistable latching relay according to claim 6 further comprising:

a block, used to resist the hitting device in the block when the hitting device moves away from the contact unit, and the block causing the rotation angle of the hitting device to be less than 180 degrees when the hitting device moves away from the contact unit to the block.

8. The bistable latching relay according to claim 3, wherein the hitting device is disposed on one side of the rotor shaft, and the hitting device rotates following the rotation of the rotor shaft;

wherein the hitting device rotates to the contact unit and causes the contact unit to be closed when the coil is applied the first direction currents, and the hitting device rotates away from the contact unit and causes the contact unit to be open when the coil is applied the second direction currents.

9. The bistable latching relay according to claim 8, wherein the rotor shaft has a moving track, and the hitting device follows the moving track when moving, and the contact unit is closed when the hitting device touches the contact unit according to the moving track, and the contact unit is open when the hitting device moves away from the contact unit according to the moving track.

10. The bistable latching relay according to claim 9, wherein the hitting device comprises:

a columnar fixed device, covering the rotor shaft and coupling to the shell, and used to offer the moving track to the rotor shaft to slide when rotating and stabilize the bistable latching relay in the open state or in the closed state; and a first hitting end, coupling to one end of the rotor shaft, being an insulator, and the first hitting end used to touch the contact unit.

11. The bistable latching relay according to claim 10, wherein the columnar fixed device further comprising:

a tenon, coupling to the rotor shaft orthogonally, and moving as the rotor shaft rotates; and a track opening, formed on the surface of the columnar fixed device to offer the moving track to the rotor shaft to slide through the tenon, and trap dents made individually in the two ends of the track opening to stabilize the tenon in each of the trap dents when the bistable latching relay is in the open state or in the closed state.

12. The bistable latching relay according to claim 3, wherein a distance from a center of the first surface of the first permeability material to the cylindrical permanent magnet is nearer than a distance from the sides of the first surface of the first permeability material to the cylindrical permanent magnet, and a distance from a center of the second surface of the second permeability material to the cylindrical permanent magnet is nearer than a distance from the sides of the second surface of the second permeability material to the cylindrical permanent magnet.

13. The bistable latching relay according to claim 12, wherein the hitting device is disposed on one side of the rotor shaft, and the hitting device rotates following the rotation of the rotor shaft;

wherein the hitting device rotates to the contact unit and causes the contact unit to be closed when the coil is applied the first direction currents, and the hitting device rotates away from the contact unit and causes the contact unit to be open when the coil is applied the second direction currents.

14. The bistable latching relay according to claim 13, wherein the rotor shaft has a moving track, and the hitting device follows the moving track when moving, and the contact unit is closed when the hitting device touches the contact unit according to the moving track, and the contact unit is open when the hitting device moves away from the contact unit according to the moving track.

15. The bistable latching relay according to claim 14, wherein the hitting device comprises:

a columnar fixed device, covering the rotor shaft and coupling to the shell, and used to offer the moving track to the rotor shaft to slide when rotating and stabilize the bistable latching relay in the open state or in the closed state; and a first hitting end, coupling to one end of the rotor shaft, being an insulator, and the first hitting end used to touch the contact unit.

16. The bistable latching relay according to claim 15, wherein the columnar fixed device further comprising:

a tenon, coupling to the rotor shaft orthogonally, and moving as the rotor shaft rotates; and a track opening, formed on the surface of the columnar fixed device to offer the moving track to the rotor shaft to slide through the tenon, and trap dents made individually in the two ends of the track opening to stabilize the tenon in each of the trap dents when the bistable latching relay is in the open state or in the closed state.

17. A bistable latching relay comprising:

an electromagnetic device with a rotor shaft and a shell for supporting the rotor shaft;

a contact unit;

a hitting device, disposed on one end of the rotor shaft, wherein the hitting device is disposed on one side of the rotor shaft, and the hitting device rotates following the rotation of the rotor shaft, wherein the hitting device comprises a columnar fixed device, covering the rotor shaft and coupling to the shell, and used to offer a moving track to the rotor shaft to slide when rotating and stabilize the bistable latching relay in the open state or in the closed state; and a first hitting end, coupling to one end of the rotor shaft, being an insulator, and the first hitting end used to touch the contact unit, wherein the contact unit being in an open state or in a closed state according to a movement of the rotor shaft through the hitting device, two ends of the contact unit electrically connecting to each other when the contact unit is in the closed state, the two ends of the contact unit disconnecting to each other when the contact unit is in the open state, wherein the hitting device rotates to the contact unit and causes the contact unit to be closed when the rotor shaft of the electromagnetic device rotates in a first direction, and the hitting device rotates away from the contact unit and causes the contact unit to be open when the rotor shaft of the electromagnetic device rotates in a second direction, wherein the rotor shaft has the moving track, and the hitting device follows the moving track when moving, and the contact unit is closed when the hitting device touches the contact unit according to the moving track, and the contact unit is open when the hitting device moves away from the contact unit according to the moving track.

18. The bistable latching relay according to claim 17, wherein the columnar fixed device further comprising:

a tenon, coupling to the rotor shaft orthogonally, and moving as the rotor shaft rotates; and a track opening, formed on the surface of the columnar fixed device to offer the moving track to the rotor shaft to slide through the tenon, and trap dents made individually in the two ends of the track opening to stabilize the tenon in each of the trap dents when the bistable latching relay is in the open state or in the closed state.

* * * * *